US006352480B1

(12) United States Patent
Macaluso

(10) Patent No.: US 6,352,480 B1
(45) Date of Patent: Mar. 5, 2002

(54) SPORTS PRACTICE NET

(75) Inventor: Anthony G. Macaluso, Escondido, CA (US)

(73) Assignee: The Jugs Company, Tualatin, OR (US)

( * ) Notice: Subject to any disclaimer, the term of this patent is extended or adjusted under 35 U.S.C. 154(b) by 0 days.

(21) Appl. No.: 09/350,564

(22) Filed: Jul. 9, 1999

(51) Int. Cl.[7] ..... A63B 57/00; A63B 69/36
(52) U.S. Cl. ..... 473/197; 473/164
(58) Field of Search ..... 473/415, 197, 473/153, 471, 478, 194, 168; 273/410

(56) References Cited

U.S. PATENT DOCUMENTS

| | | | | | |
|---|---|---|---|---|---|
| 4,381,110 | A | * | 4/1983 | Balaz | 473/197 |
| 4,703,931 | A | * | 11/1987 | Steen | 473/435 |
| 5,088,740 | A | * | 2/1992 | Peterson | 273/410 |
| 5,427,381 | A | * | 6/1995 | Macaluso et al. | 273/400 |
| 5,452,896 | A | * | 9/1995 | Core | 473/164 |
| 5,569,094 | A | * | 10/1996 | Macaluso | 473/197 |
| 5,823,885 | A | * | 10/1998 | Stempfer | 473/197 |
| 6,135,894 | A | * | 10/2000 | Cho | 473/197 |
| 6,165,085 | A | * | 12/2000 | Lubin | 473/478 |

* cited by examiner

*Primary Examiner*—Jeanette Chapman
*Assistant Examiner*—M. Chambers
(74) *Attorney, Agent, or Firm*—Olson and Olson

(57) ABSTRACT

A sports practice net assembly for stopping the flight of a projectile such as a golf ball, comprises a pair of side frame members with a central frame member disposed between them. The side frame members are preferably formed as closed loops. The central frame member has a pair of legs that extend across portions of the side frame members so that the lower ends of the legs and the lowermost portions of the side frame members support the sports practice net assembly on a generally horizontal surface. The first and second frame members are preferably are symmetrically arranged such that they are connected together at a rear portion of the sports practice net assembly and spaced apart at a front portion of the sports practice net assembly with an acute angle between their planes. The central frame member has first and second legs and an upper portion arranged to extend above the uppermost edges of the side frame members. The central frame member is arranged between the first and second side frame members with a first leg of the central frame member being connected to the first side frame member near a first front portion of the sports practice net assembly and a second leg of the central frame member being connected to the second side frame member near a second front portion of the sports practice net assembly. Netting is arranged on the frame members to stop the flight of a projectile.

8 Claims, 4 Drawing Sheets

SPORTS PRACTICE NET

BACKGROUND OF THE INVENTION

This invention relates generally to apparatus and methods that allow a person to practice hitting or throwing a ball or the like in a confined space without having the ball travel a large distance or hit other persons or objects and cause injury or damage.

SUMMARY OF THE INVENTION

A sports practice net assembly for stopping the flight of a projectile such as a golf ball, comprises a pair of side frame members with a central frame member disposed between them. The side frame members are preferably formed as closed loops. The central frame member has a pair of legs that extend across portions of the side frame members so that the lower ends of the legs and the lowermost portions of the side frame members support the sports practice net assembly on a generally horizontal surface. The first and second frame members are preferably symmetrically arranged such that they are connected together at a rear portion of the sports practice net assembly and spaced apart at a front portion of the sports practice net assembly with an acute angle between their planes.

The central frame member preferably is formed to have a generally U-shaped configuration having first and second legs and an upper portion therebetween. The central frame member is arranged between the first and second side frame members with a first leg of the central frame member being connected to the first side frame member near a first front portion of the sports practice net assembly and a second leg of the central frame member being connected to the second side frame member near a second front portion of the sports practice net assembly.

Netting is arranged on the frame members to stop the flight of a projectile.

Sleeves preferably are formed around the frame members to provide convenient means for attaching the netting thereto.

Straps may be connected to the frame members for adjusting their configurations.

A target preferably is connected to the first and second side frame members.

A fabric section may be connected between the first and second side frame members. An upper portion of the fabric section is connected to a lower edge of the central net section and is arranged to allow a ball that has been stopped by the sports practice net assembly to roll out of the sports practice net assembly.

An appreciation of the objectives of the present invention and a more complete understanding of its structure and method of operation may be had by studying the following description of the preferred embodiment and by referring to the accompanying drawings.

DETAILED DESCRIPTION OF THE INVENTION

Figure 1A:
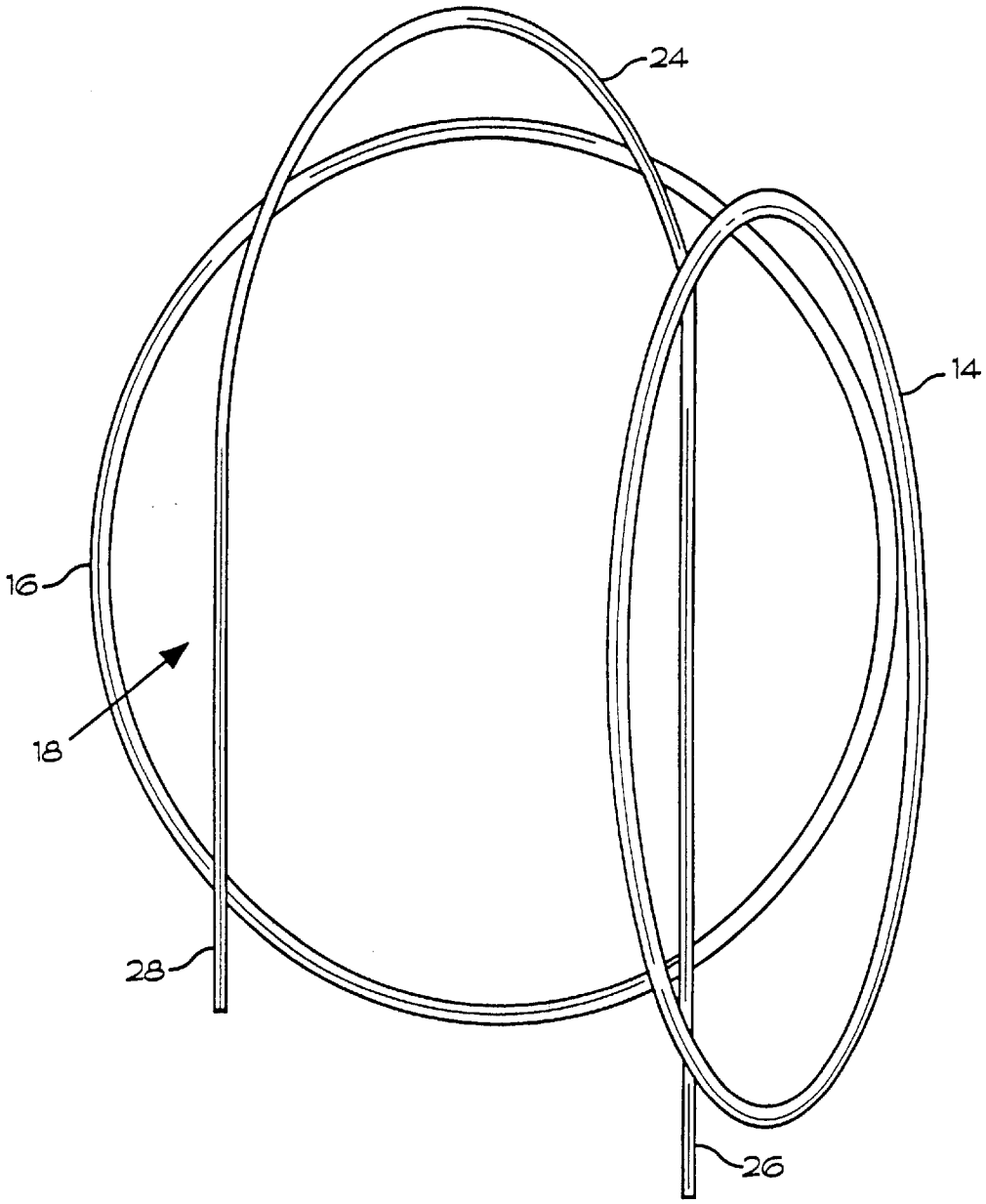
FIG. 1A is a perspective view of a frame structure that may be included in a sports practice net according to the present invention.
Figure 1B:
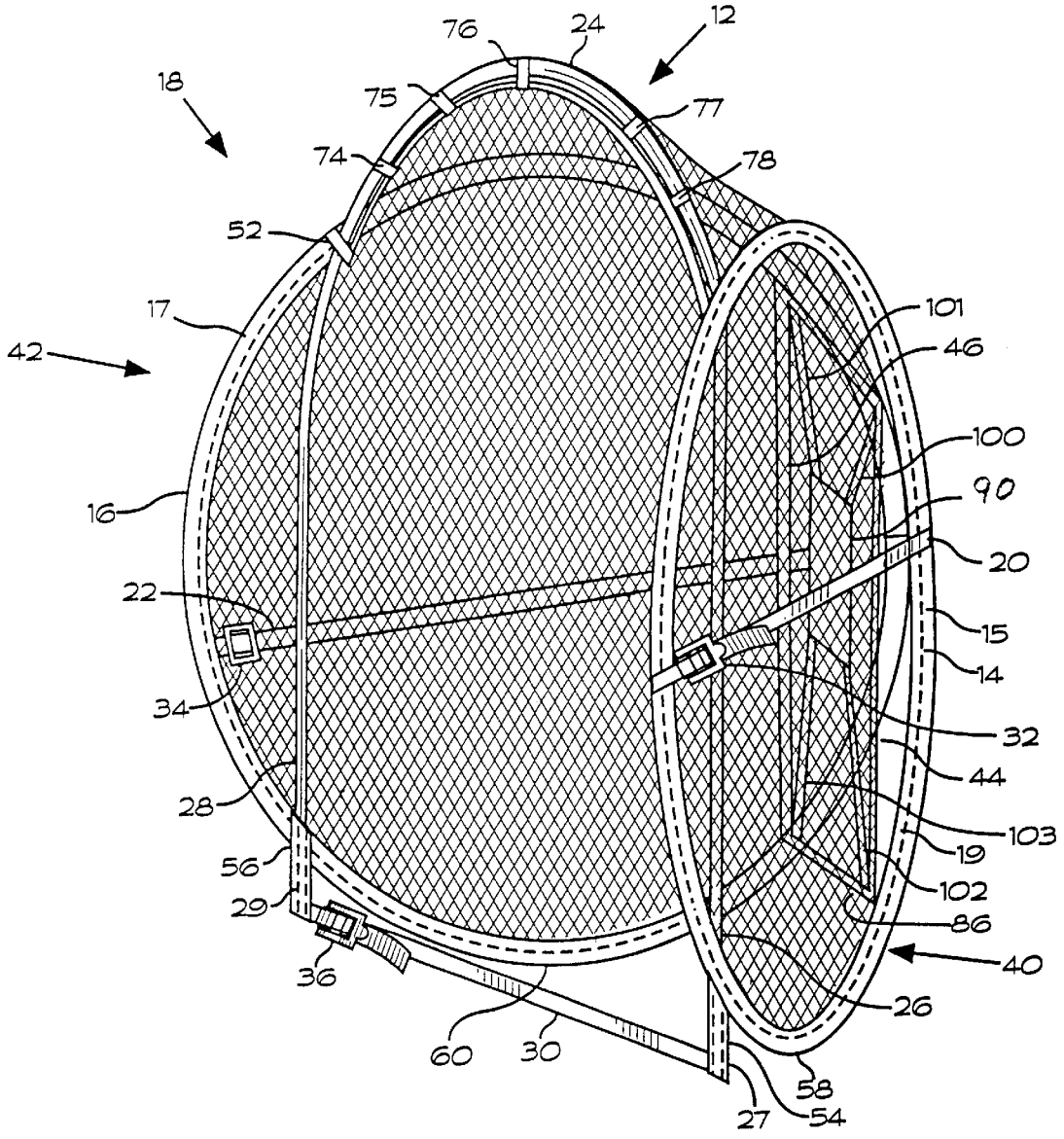
FIG. 1B is a perspective view of a complete net structure according to the present invention.

Referring to FIGS. 1A and 1B, a sports practice net 10 according to the present invention includes a frame structure 12 that includes a pair of side frame members 14 and 16 and a central frame member 18. The frame members 14,16 and 18 are preferably formed of steel spring wire. The frame members 14, 16 and 18 may alternatively be formed of carbon fibers, metal alloys, fiber glass or other material that is sufficiently elastic to permit formation of the frame members while also providing adequate support for the sports practice net 10. The material comprising the frame members 14 and 16 should be sufficiently flexible to allow the frame members 14 and 16 to be generally circular or oval in shape. The material comprising the frame member 18 should be suitable for allowing it to be formed in a generally U-shaped configuration.

The side frame members 14 and 16 preferably are configured into closed loops. The frame members 14, 16, and 18 may each be formed of a single wire or the like; or they may be formed to comprise a plurality of segmented sections joined end-to-end.

Referring to FIGS. 1B,and 2,4 and 5, when the sports practice net 10 is assembled, a pair of fabric sleeves 15 and 17 are formed around the side frame members 14 and 16, respectively. The fabric sleeves 15 and 17 are conveniently formed by stitching 19 and 21 to secure the fabric around the frame members 14 and 16, respectively.

A strap 20 extends across the central portion of the side frame member 14, and a strap 22 extends across the central portion of the side frame member 16. The straps 20 and 22 are used to control the shapes of the frame members 14 and 16. The central frame member 18 has an upper curved portion 24 that extends between two generally straight legs 26 and 28. A strap 30 preferably extends between the lower ends of the legs 26 and 28 and is used to control the spacing between them. Buckles 32, 34 and 36 best shown in FIG. 1B may be arranged to adjust the lengths of the straps 20, 22 and 30, respectively. Adjusting the lengths of the straps 20, 22 and 30 changes the configurations of the frame members 14, 16 and 18, respectively.

The central frame member 18 may be formed in configurations other than U-shaped. The central frame member should have the legs 26 and 28 and a central portion 24 that extends above the uppermost portions of the side frame members when the sports practice net is assembled.

Figure 2:
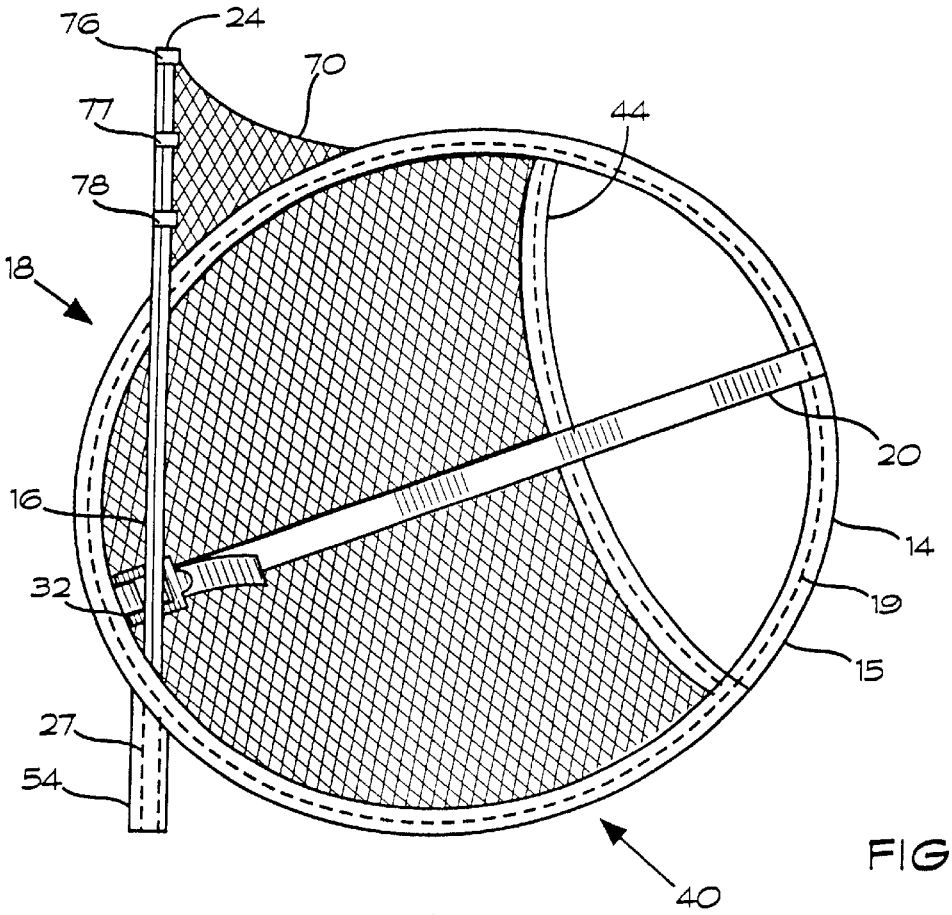
FIG. 2 is a side elevation view of the net of FIG. 1B.
Figure 3:
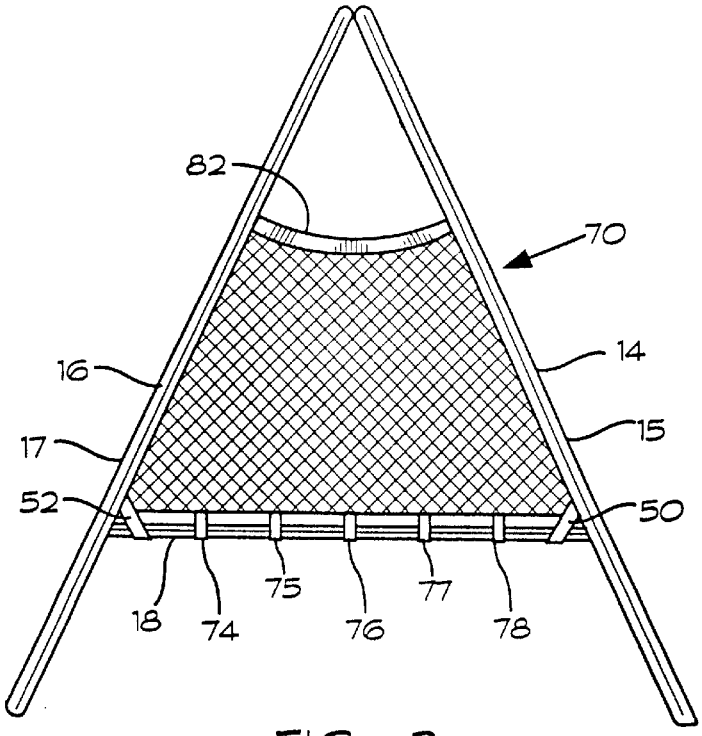
FIG. 3 is a top plan view of the net of FIGS. 1*b* AND 2.
Figure 4:
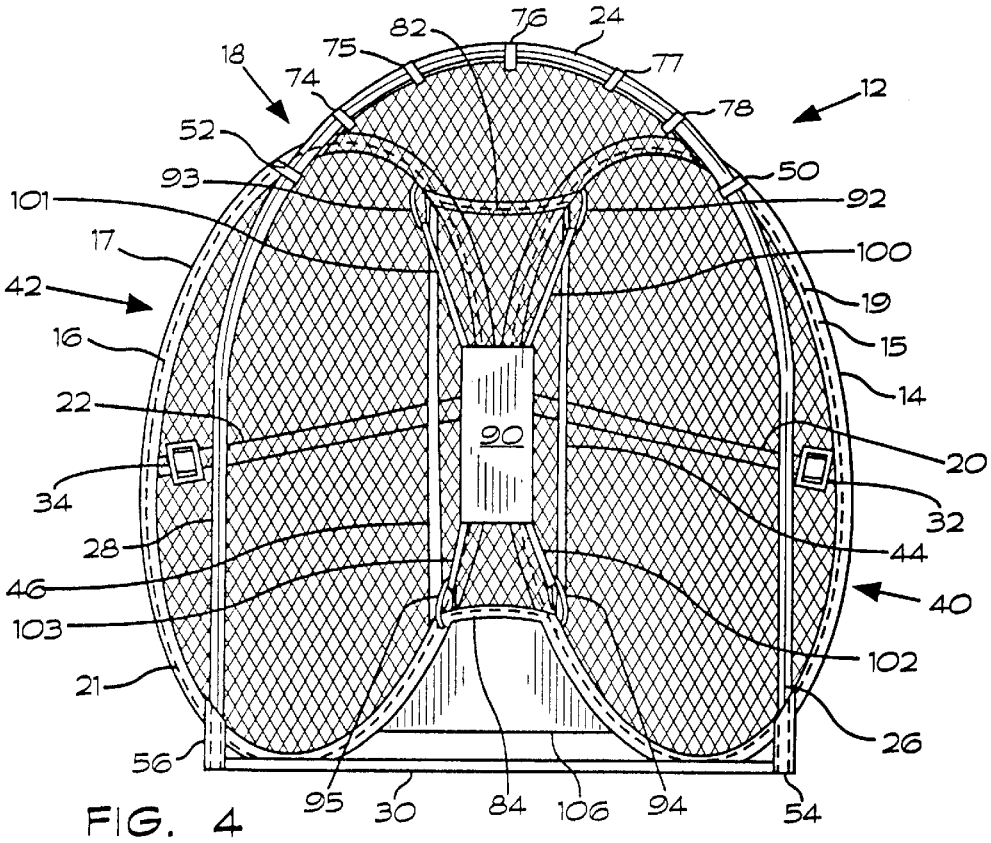
FIG. 4 is a front elevation view of the net according to the present invention.
Figure 5:
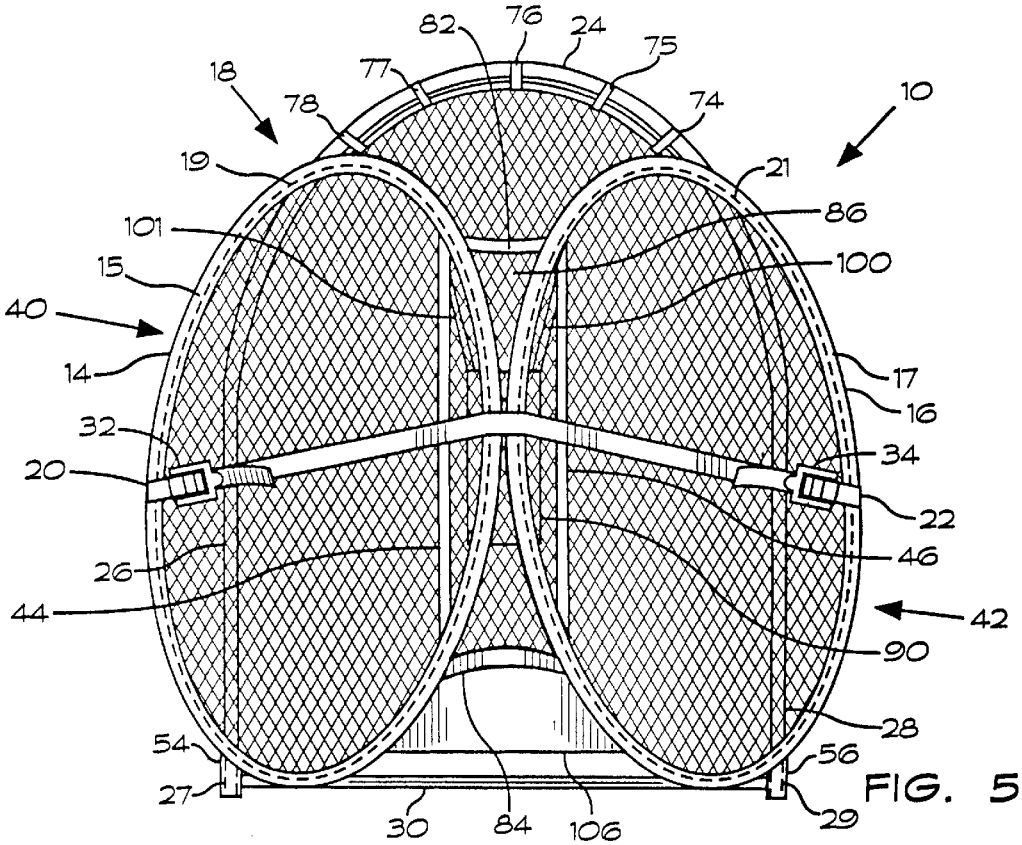
FIG. 5 is a rear elevation view of the net according to the present invention.

A first side net section 40 is attached to the sleeve 15 by suitable stitching or the like, and a second side net section 42 is attached to the sleeve 17 so that the two sides of the sports practice net 10 are essentially identical. As best shown in FIG. 2, a fabric band 44 may be arranged to extend across the frame member 14. The netting 40 is attached to the fabric band 15 and the band 44 so that the netting is inside the part of the frame member 14 bounded by the fabric bands 15 and 44. As shown in FIGS. 3–5, a fabric band 46 is connected to the fabric band 17 and arranged to extend across the frame member 16. The configurations of the frame members 14 and 16, the fabric bands 15 and 17, the fabric bands 44 and 46, the straps 20 and 22 and the netting 44 and 46 are such that the two sides of the net 10 are essentially identical.

Referring to FIGS. 1A, 1B, 2–5, the center frame member 18 is mounted between the two side frame members 14 and 16. The frame member 18 has legs 26 and 28 that are connected to the frame members 14 and 16 by any convenient means, such as a pair of loops 50 and 52 that are in turn connected to the fabric sleeves 15 and 17, respectively. The lef 26 of the center frame member 18 passes through the loop 50 and extends across a portion of the frame member 14. The lower end 27 of the leg 26 extends into a sleeve 54, which is connected to the fabric band 15. In a similar manner, the leg 28 of the center frame member 18 passes through the loop 52 and extends across a portion of the frame member 16. The lower end 29 of the leg 28 extends into a sleeve 56, which is connected to the fabric band 17.

When the net 10 is assembled and arranged for use, it rests upon the ends 27 and 29 of the legs 26 and 28, respectively, and the lowermost portions 58 and 60 of the side frame members 14 and 16, respectively.

An upper net section 70 is attached to the upper curved portion 24 of the U-shaped central frame member 18, which extends above the side frame members 14 and 16. As shown in FIGS. 1B and 3–5, the netting 70 may be attached to the central frame member 18 by a plurality of loops 74–78. The netting 70 extends from the upper portion 24 of the frame member 18 to the sleeves 15 and 17. The net sections 40, 42, 70 and 86 may be formed to comprise a single piece of netting.

A fabric band 82 extends between the sleeves 15 and 17 above the straps 20 and 22. A fabric band 84 extends between the sleeves 15 and 17 below the straps 20 and 22. The fabric bands 82 and 84 are connected to the fabric bands 44 and 46 and form a support for a rear net section 86, which is located near the rear portion of the sports practice net 10.

As best shown in FIGS. 1B, 4 and 5, a generally rectangular ball stop 90 may be connected to the sleeves 15 and 17 near the fabric band 82, and a pair of lower loops 94 and 95 are connected also to the sleeves 15 and 17 near the fabric band 84. Cords 100–103 extend from the corners of the ball stop 90 to the loops 92–95. The cords 100–103 preferably are tied to their corresponding loops 100–103 to permit adjustment of the position, or removal, of the ball stop 90.

The sports practice net 10 may further include a fabric section 106 connected to the fabric band 84 and arranged to extend between lower portions 108 and 110 of the sleeves 15 and 17, respectively.

When the sports practice net 10 is in use to practice golf, the ball stop, or target, 90 provides a convenient target for a correctly stricken ball to hit. The ball stop 90is preferably loosely mounted to the side frame members 14 and 16 so that the momentum of the ball is dissipated upon hitting the ball stop 90. The ball then falls to the fabric section 106, which is arranged such that the ball rolls back away from the sports practice net 10.

The sports practice net 10 has advantageous features not found in the prior art. Referring to FIG. 3, the angle θ between the planes of the frame members 14 and 16 is adjustable by means of the strap 30. The straps 20 and 22 provide the capability of adjusting the shapes of the side frame members 14 and 16. These adjustment capabilities make use of the sports practice net 10 more convenient. The side net sections 40 and 42 are arranged to reduce the possibility that a golf ball hit with a side spin component ("slice" or "hook") will miss the sports practice net 10, which sometimes occurs with prior art golf practice nets. The upper net portion 70 is designed to intercept balls having trajectories that go over the ball stop 90.

The structures and methods disclosed herein illustrate the principles of the present invention. The invention may be embodied in other specific forms without departing from its spirit or essential characteristics. The described embodiments are to be considered in all respects as exemplary and illustrative rather than restrictive. Therefore, the appended claims rather than the foregoing description define the scope of the invention. All modifications to the embodiments described herein that come within the meaning and range of equivalence of the claims are embraced within the scope of the invention.

What is claimed is:

1. A sports practice net assembly for stopping the flight of a projectile such as a golf ball comprising:

a) a first side frame member arranged to form a closed loop, b) a first side net section supported by and extending across the first side frame member, c) a second side frame member arranged to form a closed loop, d) a second side net section supported by and extending across the second side frame member, e) the first and second side frame members being positioned-closely adjacent each other for pivoting at the rear ends thereof and spaced apart at the front ends thereof, f) a central frame member having spaced apart first and second legs having bottom ends disposed for supporting engagement with an underlying support and a central upper connection portion, the central frame member extending between and secured removably to the first and second side frame members adjacent the spaced apart front ends thereof, and g) central net section connected to and extending across the upper connection portion of the central frame member and the upper portions of the first and second side frame members, to form a top closure for the net assembly.

2. The net assembly of claim 1 including a target connected to the first and second side frame members and extending between them intermediate the front and rear ends thereof.

3. The net assembly of claim 2 including a fabric section connected between the first and second side frame members and having an upper portion connected to a lower edge of the central net section, the fabric section being arranged to allow a ball that has been stopped by the target to roll toward the front of the net assembly.

4. The net assembly of claim 1 wherein the rear ends of the first and second side frame members form a rear apex and an included acute angle between them.

5. The net assembly of claim 1 wherein the first and second side frame members are resilient, and first and second adjustable strap members extend adjustably across said first and second side frame members for adjusting the configurations thereof.

6. The net assembly of claim 1 wherein the central frame member is resilient and an adjustable strap member extends between the spaced apart legs adjacent the bottom ends thereof for adjusting the spacing between said legs and the corresponding spacing between the front portions of the spaced apart side frame members.

7. The net assembly of claim 1 wherein the bottom ends of the first and second spaced apart legs of the central frame member and the spaced apart bottom portions of the first and second side frame members are arranged to support the net assembly in upright position upon a substantially horizontal surface.

8. The net assembly of claim 1 including:

a) a first sleeve arranged to enclose the first side frame member, the first side net section being connected to the first sleeve, b) a second sleeve arranged to enclose the second side frame member,the second side net section being connected to the second sleeve, c) a third sleeve connected to the first sleeve and arranged to receive the lower end of the first leg of the central frame member, d) a fourth sleeve connected to the second sleeve and arranged to receive the lower end If the second leg of the central frame member, e) a first loop connected to the first net section, f) a second loop connected to the second net section, and g) the central frame member being arranged to pass through the first and second loops to secure the upper central connecting portion of the central frame member to the first and second sleeves, the third and fourth sleeves and the first and second loops being arranged to retain the central frame member in a predetermined position relative to the first and second side frame members.

* * * * *

UNITED STATES PATENT AND TRADEMARK OFFICE

CERTIFICATE OF CORRECTION

PATENT NO. : 6,352,480 B1
DATED : March 5, 2002
INVENTOR(S) : Anthony G. Macaluso It is certified that error appears in the above-identified patent and that said Letters Patent is hereby corrected as shown below:

Column 4,
Line 33, g) "central net section" should be -- a central net section --.

Column 5,
Line 12, d) "the lower end If the" should read -- the lower end of the --.

Signed and Sealed this

Twenty-first Day of May, 2002

*Attest:*

*Attesting Officer*

JAMES E. ROGAN
*Director of the United States Patent and Trademark Office*